United States Patent [19]

Engelberts

[11] 4,336,642

[45] Jun. 29, 1982

[54] METHOD OF ENLARGING THE HEAT EXCHANGE SURFACE OF A TUBULAR ELEMENT

[75] Inventor: Gerhardus A. Engelberts, Breda, Netherlands

[73] Assignee: B.V. Machinefabriek Breda v/h Backer & Rueb, Breda, Netherlands

[21] Appl. No.: 63,342

[22] Filed: Aug. 2, 1979

Related U.S. Application Data

[60] Division of Ser. No. 830,311, Sep. 2, 1977, Pat. No. 4,163,473, which is a continuation of Ser. No. 640,765, Dec. 15, 1975, abandoned.

[30] Foreign Application Priority Data

Dec. 24, 1974 [NL] Netherlands ..... 7416886
Dec. 24, 1974 [NL] Netherlands ..... 7416887

[51] Int. Cl.[3] ..... B23P 15/26

[52] U.S. Cl. ..... 29/157.3 A; 165/184; 165/157; 29/157.3 AH

[58] Field of Search ..... 29/157.3 A, 157.3 B, 29/157.3 AH; 113/118 A, 118 B; 165/184, 157, 183

[56] References Cited

U.S. PATENT DOCUMENTS

| | | | |
|---|---|---|---|
| 1,699,542 | 1/1929 | Murray | 165/183 X |
| 1,721,808 | 7/1929 | Kettering | 165/183 X |
| 1,942,211 | 1/1934 | Hartwig | 165/183 |
| 1,960,305 | 5/1934 | Emmons et al. | 29/157.3 AH |
| 3,789,786 | 2/1974 | Wiedenmann et al. | 29/157.3 AH |
| 3,959,867 | 6/1976 | Frost | 29/157.3 AH |
| 3,968,554 | 7/1976 | Roffelsen | 29/157.3 AH |

FOREIGN PATENT DOCUMENTS

| | | | |
|---|---|---|---|
| 1078993 | 5/1954 | France | 165/183 |
| 636910 | 5/1950 | United Kingdom | 165/183 |

*Primary Examiner*—Lowell A. Larson
*Assistant Examiner*—V. K. Rising
*Attorney, Agent, or Firm*—William P. Keegan

[57] ABSTRACT

A method of enlarging the heat exchange surface of a tubular element used for guiding a medium in a heat exchanger, and the product obtained thereby.

4 Claims, 11 Drawing Figures

FIG. 2
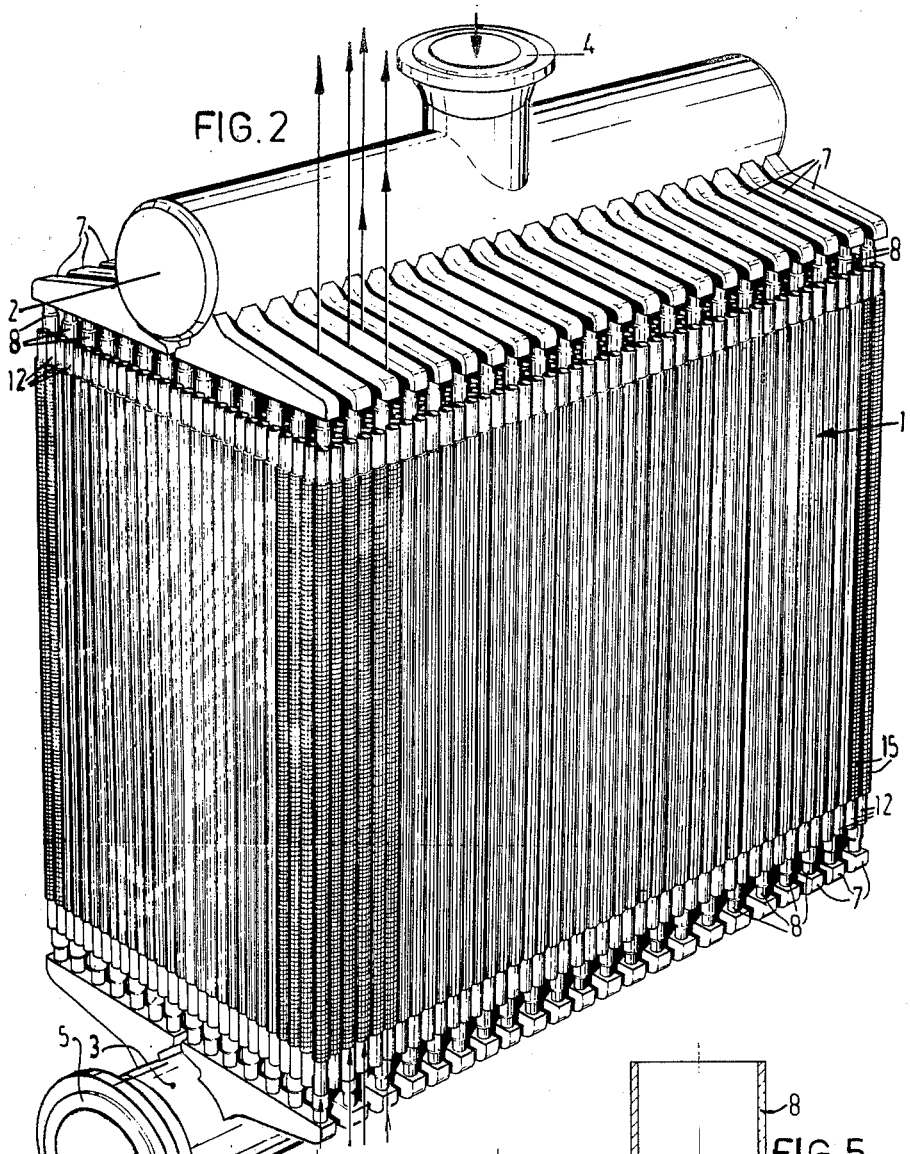
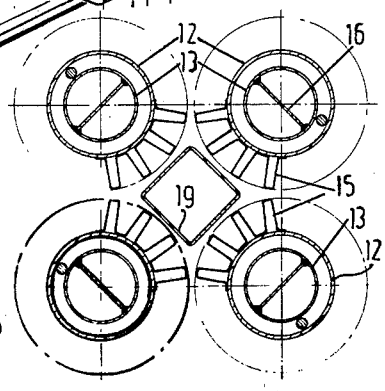
FIG.6
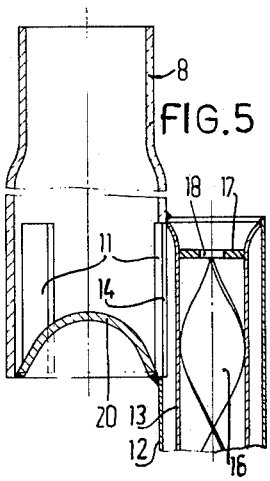
FIG.5

METHOD OF ENLARGING THE HEAT EXCHANGE SURFACE OF A TUBULAR ELEMENT

This application is a division of application Ser. No. 830,311 filed Sept. 2, 1977 now U.S. Pat. No. 4,163,473, which is a continuation of application Ser. No. 640,765 filed Dec. 15, 1975, now abandoned.

The invention relates to a method of enlarging the heat exchange surface of a tubular element used for guiding a medium in a heat exchanger, and the product obtained thereby.

In known heat exchangers, the tubes are held and fixed at both ends in tube plates which are of a comparatively heavy weight. With low capacities, these heat exchangers yield excellent results, but with higher capacities this known construction is too heavy. Moreover, this construction is not suitable for withstanding heavy stresses due to temperature fluctuations. In the construction of an improved heat exchanger disclosed in aforementioned application Ser. No. 830,311, now U.S. Pat. No. 4,163,473, the tube plate is divided into separate elements so that thermal stresses can be better absorbed. With the construction there disclosed, tubes widely spaced apart in the bundle and likely to be subjected to completely different thermal loads can match their individual conditions independently of one another, thereby increasing the capacity of the heat exchanger.

If the heat exchanger has to perform heat transfer between media having great differences in volume passing through per unit time, which may be the case with regenerators for combustion engines, in which one medium is formed of compressed air for combustion and the other medium is provided by the exhaust gases of the engine, the tubes of the heat exchanger may have a coaxial inner pipe within each tube. Thus, one medium is passed through the annular space between the pipe and the tube while the other medium flows both around the outer tube and through the inner pipe.

The present invention's object is to facilitate the enlargement of the heavy exchange surface of a tubular element.

In carrying out the invention, a first length of flexible material is fastened to the surface of the tubular element, and then wound in a stretched state around the tube while simultaneously a second length of material, which had previously been shaped in a recessed or corrugated form, is clamped tightly between the tube and the first length of material.

The advantage of the method of the invention resides in that the notched or corrugated length of material, when arranged around the tube, is not loaded in the plane of the material, but is only loaded in a direction at right angles thereto owing to the clamping effect between the first length of material and the tube to which it is fastened. As a result, the corrugated or notched shape of the second length of material is not varied substantially while a satisfactory contact pressure between the material and the tube is assured. Thus, the desired size of the heat exchange surface can be maintained in a simple manner.

In order to improve the heat conduction across the contact surfaces between the second length of material and the tube, the surface of the latter may be covered beforehand with a fastening means such as copper foil or soldering paste which is heated, subsequent to winding, at a suitable fusing temperature.

The dimensions of the two lengths of material may be arbitrary. A length of material may be considered as the dimension which, in an axial direction, is equal to the length of the tube. Therefore, if the tube has to be provided all around with an enlarged heat exchange surface, a length of material need be provided enabling one revolution around the tube. Alternatively, strips of material may be employed which are helically wound around the tube.

The connection of the first length of material with the tubular element, or with itself, is preferably established by means of spot welding. The first length of material may be held in a stretched state in many ways, but it is preferred to guide this length of material across resistance means so that during the winding operation a resistive force is exerted on the first length of material to hold it in a stretched state. A particularly effective embodiment is that in which the tube is turned in a support about its own axis.

The invention furthermore relates to the product obtained by said method which permits the heat exchange surface to assume many shapes. A flexible sheet may be considered to form the second length of material which is locally recessed on one side or on both sides. The second length of material may, as an alternative, be formed by a strip of material previously bent or folded in a zigzag fashion, with the dimension in the axial direction being smaller than the length of the tube. This strip is helically wound around the tube so that the whole length thereof may be covered.

The invention proposes to arrange the folds of the strip at an angle complementary to the helical angle with respect to the side edges of the strip. This has the advantage that after the strip has been wound around the tube, the fold edges are accurately disposed axially to ensure a particularly satisfactory conduction through the wall and the strip shaped material.

Further features of the invention will be gained from the foregoing and from the description of a preferred embodiment of the invention which follows.

In the drawing:

FIG. 2 is a perspective view of the heat exchanger of FIG. 1;

FIG. 5 is an axial sectional view of a detail of FIG. 3, indicating the mode of connection of the end of the tube member of FIG. 3 to an element of a second distribution or collection manifold;

FIG. 6 is an arbitrary cross sectional view of a group of tube elements fastened to an element of FIG. 5;

Figure 1:
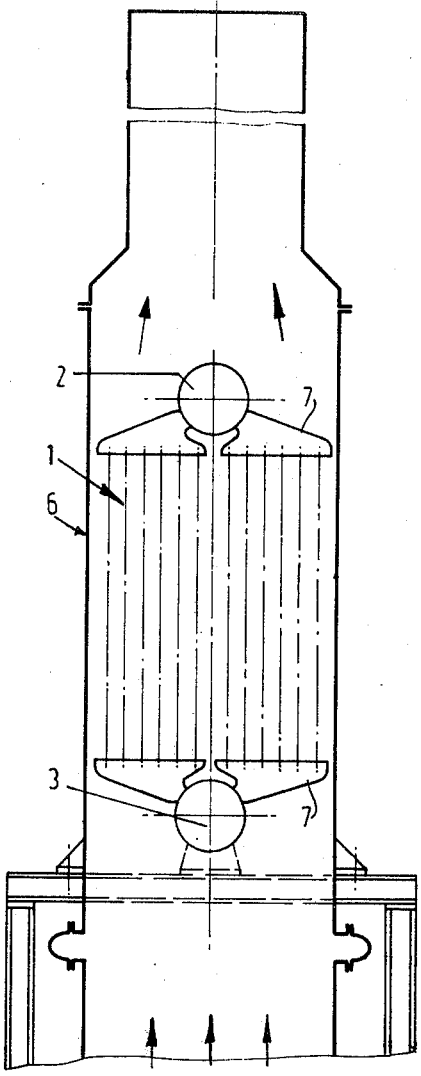
FIG. 1 is a schematic illustration of a contact flow heat exchanger embodying the invention.

The embodiment of a heat exchanger in accordance with the invention to be described hereinafter comprises generally a tube bundle 1 connected on the top and bottom sides with a distribution header 2 and a collection header 3, respectively. The tube bundle guides one medium from the connecting flange 4 of the distribution header 2 towards the connecting flange 5 of collection header 3. The other medium is guided along the tube bundle 1 by a surrounding envelope 6. The other medium flows in upward direction, as viewed in FIG. 1, so that heat exchange takes place in counterflow between the two media.

It will be noted that one medium is divided stepwise from distribution header 2 into smaller partial streams before it reaches tube bundle 1. On the other hand, these partial streams are stepwise united to a main stream into collection header 3. This division and integration of one medium is performed in a first stage by the manifolds 7 connected with headers 2 and 3. In order to divide the partial streams again in element 7, the joining elements of the second stage 8 are provided, and these are finally connected with a plurality of tubes in bundle 1. In the embodiment shown, two stages are thus formed, but, if desired, more than two stages may be provided.

Figure 3:
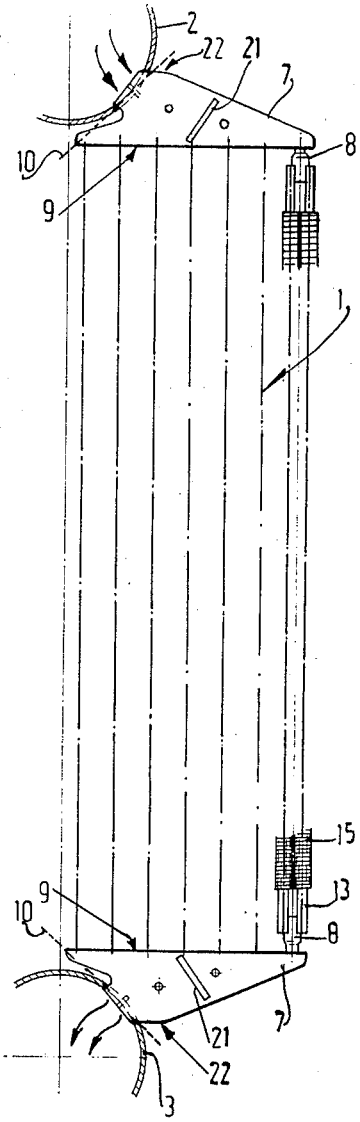
FIG. 3 is a schematic front view of a part of the tube bundle of FIG. 2.

Each element 7 has the shape of a flat box, one side 9 of which is connected via elements 8 with the tubes in bundle 1, whereas the side 10 joining the former side 9, and indicated by the broken line in FIG. 3, is connected with the distribution header 2 or collection header 3. This construction provides a particularly elastic fastening of the tubes to the headers 2 and 3.

FIG. 2 shows in particular that the most compact structure is obtained by means of a fish-bone array of manifolds 7 with respect to the headers 2 and 3 and, since a contact stream heat exchanger is being considered here, the space between manifolds 7 will exceed the width of the elements in order to ensure a minimum resistance.

The cylindrical elements 8 of the second distribution stage have apertures in their sheaths. See FIG. 5. These apertures 11 are individually joined by a tube of bundle 1, and if the apertures are uniformly arranged along the circumference of element 8, a tube array as shown in FIG. 6 can be obtained. FIG. 6 shows four tubes, but it is obvious that a larger or smaller number may be used.

In the heat exchanger shown, constructed as a regenerator, the tubes in bundle 1 are shaped so that the volume of one medium matches that of the other medium to the optimum. For this purpose, the tube comprises an outer pipe 12 and an inner pipe 13. (See FIGS. 4, 5, and 6). One medium passes through an annular space between the two pipes 12 and 13, and the other medium flows along the outer side of pipe 12 and through the interior of pipe 13. The two pipes, 12 and 13, are interconnected at their ends so that at the ends the annular space between the two pipes is completely closed with the exception of passages 14 in the wall of pipe 12. These apertures 14 communicate with the passages 11 of the cylindrical element 8. This disposition and connection of pipes 12 and 13 with elements 8 ensure a particularly satisfactory conveyance of the other medium through inner pipe 13.

Figure 4:
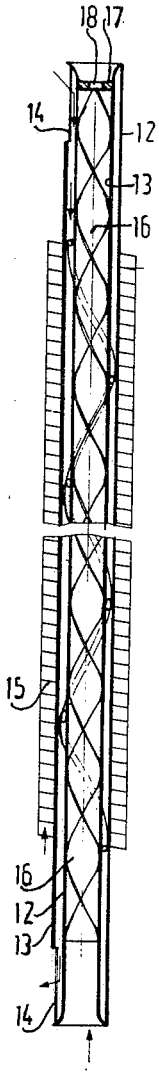
FIG. 4 is an axial sectional view of a tube member suitable for use in a heat exchanger employed as a regenerator.

The heat exchanging surface of outer pipe 12 may be enlarged by fastening members 15 to the outer surface thereof in the form of vanes or a folded tape helically wound around pipe 12. A member of this structure may also be arranged in the inner pipe 13, but a particularly simple embodiment is shown in FIG. 4 as a helically torsioned plate 16. The pitch of the helix can be adapted to the properties of the other medium in order to obtain an optimum heat transfer. The flow rate through the inner pipe 13 can be controlled by means of a transverse partition 17 which is preferably disposed at the end of pipe 13 and is provided with an uninterrupted hole 18, the diameter of which determines the volume of the medium flow.

The annular space between the two pipes 12 and 13 may also accommodate a helical partition, the pitch and direction of which can be adapted to the properties of the one medium.

In the spaces between the tubes of bundle 1, displacer bodies 19 may be arranged loosely between the cylindrical elements. The bodies 19 ensure a most intimate flow of the other medium along pipe 12.

In order to obtain an optimum conveyance of the stream at the transition between the annular space between pipes 12 and 13 and the cylindrical element 8, the side 20 of element 8 remote from element 7 is depressed as shown in FIG. 5.

The space between the elements 7 of the first distribution of collection stage may be provided with vanes 21 for guiding the other medium through the tube bundle 1. The vanes are preferably fastened at an angle to the sidewalls of manifolds 7.

An advantage in mounting is obtained by holding the distal sides 22 of opposite manifolds 7 in relatively parallel positions. The unit formed by the manifolds 7 and the tube bundle 1 can thus be slipped, without wriggling, into the previously set headers 2 and 3 and welded in place.

Figure 7:
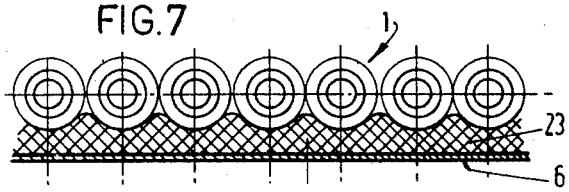
FIG. 7 is a cross sectional view of part of the outer tubes of the bundle and the envelope of the heat exchanger of FIG. 1.

The construction of the heat exchanger, as described, is particularly suitable for the separate support of the tube bundle 1 and its distribution and collection headers 2 and 3, and the envelope 6. See FIG. 1. Therefore, the envelope 6 may be a comparatively light weight structure since, in fact, it serves only to guide the other medium. Between envelope 6 and the outer tubes in bundle 1 a deformable or elastic layer 23 may be provided (FIG. 7) which, on one hand, insulates the wall of envelope 6 from the heat of the other medium, and, on the other hand, ensures a flow of the other medium as close as possible to the tubes of bundle 1.

Referring to FIGS. 8 to 11, the reference numeral 31 designates a tubular element through which flows a medium to be cooled or heated. The outer surface of element 31 is enlarged by a folded, corrugated, or bulging sheet or strip 32 which is arranged around the element. This arrangement is carried out by the method of the present invention with the aid of an additional length of material 33, one edge or end of which is fastened to the surface of element 31 by spot welding. See FIG. 9. The length of material 33 is kept in the stretched state by resistive means 34 while element 31 is turned about its center line in a support not shown. Prior to turning the element 31, the folded strip 32 first is arranged between the stretched strip 33 and element 31 so that it is clamped tight during rotation. From FIGS. 8 to 11 it will be apparent that, during rotation of element 31, the loose end portion of folded strip 32 does not produce any tensile load in the plane of the strip, but that only a pressure force is exerted at right angles to the pipe surface. Since a tensile force is not exerted in the strip 32, the folds thereof are not stretched so that the desired heat exchange surface can be obtained in a simple manner.

Figure 8:
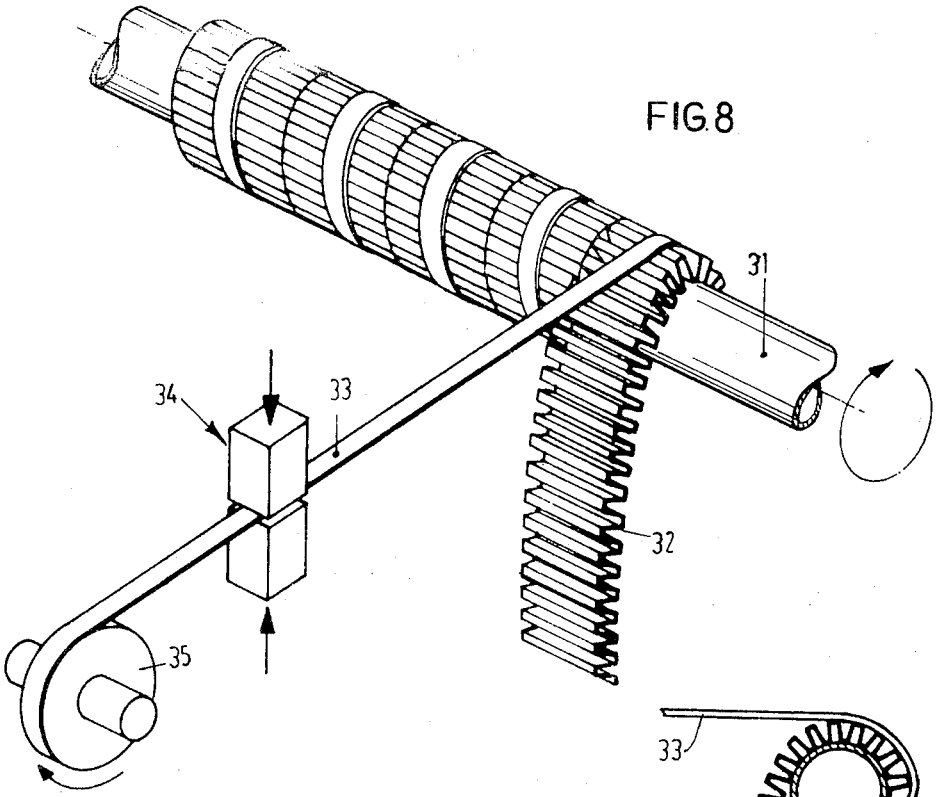
FIG. 8 is a perspective view of a preferred embodiment for enlarging the heat exchange surface of a tube.

FIG. 8 shows that a strip-shaped folded length of material 32 and a strip-shaped length of material 33 are initially wound off a stock reel 35. Winding is performed in a helical fashion, but it will be apparent that viewed in the axial direction of the element 31 the two strips of material may have the same length as the tubular element 31. In order to accomplish a complete enlargement of the surface of element 31, the element need only be turned through one revolution.

If the folded strip is helically wound around element 31, it is preferred to arrange the folding edges 36 at an angle to the side edges 37 of strip 32, which angle is complementary to the pitch angle. See FIG. 10. After folded strip 32 is wound around element 31, the contact surface with a width "b" (see FIG. 10) will extend in an axial direction. This arrangement materially enhances the conductivity between element 31 and folded strip 32.

Figure 9:
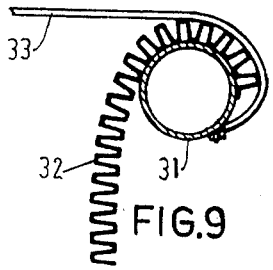
FIG. 9 is an axial elevational view of the tube of FIG. 8.
Figure 10:
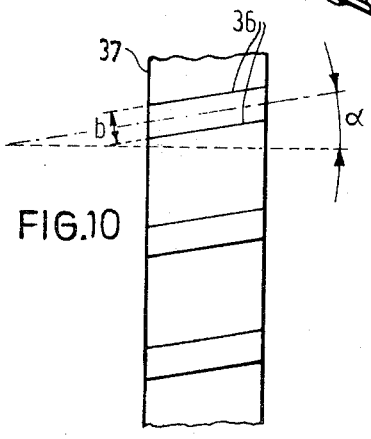
FIG. 10 is a plan view of a folded strip used as shown in FIGS.8 and 9.
Figure 11:
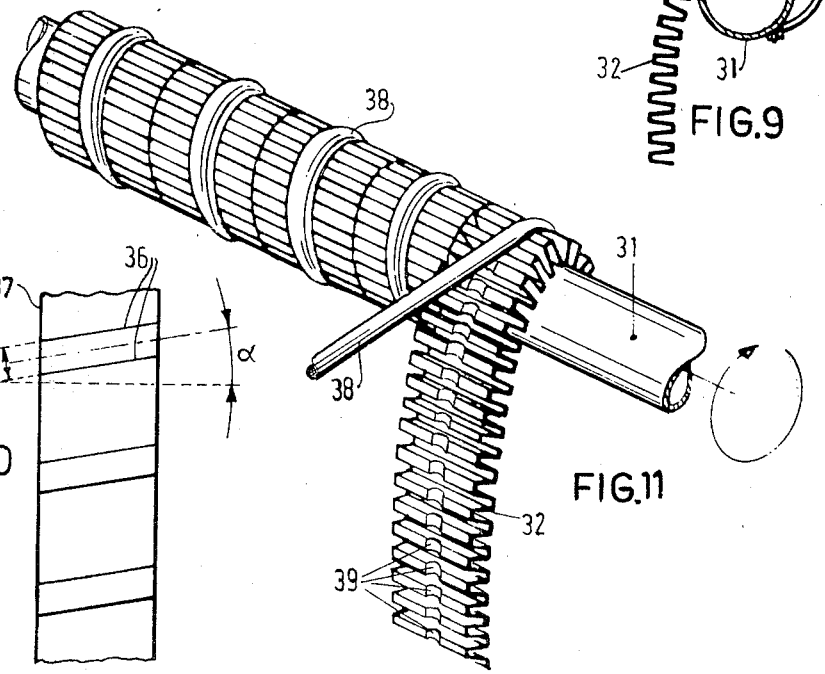
FIG. 11 is an elevational view like FIG. 8, but with a wire shaped first length of material.

FIG. 11 shows a wire 31 instead of the flat strip 33. As a further feature, recesses 39 are provided in the peaks of the folded strip 32 to form a guide groove for wire 38. As a matter of course, other guiding means such as projecting cams may be used. In the preferred embodiment of FIGS. 8 to 11, strip 32 is shown folded trapezoidally. Of course, other folding configurations, such as a triangular fold, could be employed. The section of the tubular element 31 shown in FIGS. 8 and 9 is round, but any other shape may be used as desired. Also, it should be noted that the width of strip 33 may be equal to the width of strip 32. Moreover, more than one tensile strip or wire, 32 an 38, may be employed.

Having thus described the invention, it is clear that many different embodiments thereof could be provided without departing from the spirit and scope of the invention, and, therefore, it is intended that the foregoing specification and the drawing be interpreted as illustrative rather than in a limiting sense.

What is claimed is:

1. The method of fabricating a heat exchange element including a corrugated heat transfer strip secured to a tubular element by a clamping strip, said method comprising the steps of providing a tubular element, a length of a corrugated heat transfer strip, and a clamping strip, securing one end of said clamping strip to said tubular element, placing one end of said corrugated strip between said clamping strip and said tubular element, helically winding said clamping strip and said corrugated strip simultaneously on said tubular element while said clamping strip is maintained under tension so that said corrugated strip is continuously clamped to said tubular element, and after said length of corrugated strip is clamped to said tubular element securing said clamping strip to the thus formed heat exchange element.

2. The method of fabricating a heat exchange element according to claim 1 wherein the corrugations of said corrugated strip are disposed at an angle to the edges of said strip so that when said strip is helically wound on the tubular element the corrugations run parallel to the axis of the tubular element.

3. The method of fabricating a heat exchange element according to claim 1 wherein the corrugations of said corrugated strip are formed as substantially flat furrows and ridges.

4. The method of fabricating a heat exchange element according to claim 1 or 2 or 3 including the steps of applying solder means to said tubular element and heating the heat exchange element after the corrugated strip is secured to the tubular element by said clamping strip to assure intimate contact between said tubular member and said corrugated strip and thereby provide for improved heat conduction between said tubular element and said corrugated strip.

* * * * *